US005511744A

United States Patent [19]

Abe et al.

[11] Patent Number: 5,511,744

[45] Date of Patent: Apr. 30, 1996

[54] ROLL PAPER FEEDING APPARATUS FACILITATING ROLL PAPER SETTING OPERATION

[75] Inventors: Takashi Abe; Naoto Yoshino; Takeshi Okoshi; Hiroyasu Ishizuka, all of Saitama, Japan

[73] Assignee: Fuji Xerox Co., Ltd., Tokyo, Japan

[21] Appl. No.: 135,631

[22] Filed: Oct. 14, 1993

[30] Foreign Application Priority Data

Oct. 30, 1992 [JP] Japan ..... 4-292870

[51] Int. Cl.[6] ..... B65H 16/08

[52] U.S. Cl. ..... 242/564.5; 242/564.3; 242/563

[58] Field of Search ..... 242/562, 562.1, 242/563, 563.2, 564, 564.1, 564.2, 564.3, 564.4, 564.5, 565

[56] References Cited

U.S. PATENT DOCUMENTS

| | | | |
|---|---|---|---|
| 3,489,361 | 1/1970 | Marion et al. | 242/562 |
| 3,861,610 | 1/1975 | Landis et al. | 242/564.1 |
| 4,066,220 | 1/1978 | Beck et al. | 242/564.4 |
| 4,283,021 | 8/1981 | Nishida | 242/563 |
| 4,385,958 | 5/1983 | Long | 242/563 |
| 4,690,344 | 9/1987 | Yokota | 242/564.1 |
| 4,699,034 | 10/1987 | Sue | 242/564 |
| 4,928,897 | 5/1990 | Satou et al. | 242/564.4 |
| 5,060,877 | 10/1991 | Bullivant | 242/564.5 |
| 5,187,531 | 2/1993 | Ozawa et al. | 242/563 |

FOREIGN PATENT DOCUMENTS

| | | | |
|---|---|---|---|
| 56-149940 | 11/1981 | Japan | 242/562.1 |
| 59-16459 | 1/1984 | Japan | 242/564.4 |
| 63-123752 | 5/1988 | Japan | 242/564.4 |
| 1-98547 | 4/1989 | Japan | 242/564.4 |
| 1-187133 | 7/1989 | Japan . | |

*Primary Examiner*—John P. Darling

*Attorney, Agent, or Firm*—Finnegan, Henderson, Farabow, Garrett & Dunner

[57] ABSTRACT

When an operator manually rotates flanges for holding roll paper, flange placement rollers rotate accordingly. Paper is supplied from the roll paper, and rotational force of one of the flange placement rollers is transmitted to a drive roller by a gear mechanism. Once the tip portion of the paper is held between the drive roller and an idler roller, the paper is semi-automatically fed to a set position by rotation of the drive roller. A torque limiter is provided in the gear mechanism to prevent an undesirably large load from being exerted on the paper.

9 Claims, 6 Drawing Sheets

ROLL PAPER FEEDING APPARATUS FACILITATING ROLL PAPER SETTING OPERATION

BACKGROUND OF THE INVENTION

The present invention relates to a roll paper feeding apparatus for feeding paper from roll paper (including machine glazed paper) to an image forming unit of a printer, copier, facsimile machine, etc. and, more specifically, relates to a roll paper feeding apparatus having a mechanism of semi-automatically setting the tip portion of roll paper at a predetermined set position.

In conventional image forming apparatuses for producing recorded sheets for a large-size document such as a drawing, roll paper, rather than cut sheets, is loaded in a paper feeding unit, and paper supplied from the roll paper is cut into sheets of a desired size, which are then forwarded to an image recording unit.

In the above conventional image forming apparatuses, after the roll paper is loaded at a predetermined position, an operator brings the tip portion of the roll paper to a holding position (nip position) of a paper feed roller that consists of a drive roller and an idler roller while pinching the tip portion. In this state, the operator has the paper held by the paper feed roller and its tip portion set at a predetermined position (set position) by manually rotating the paper feed roller, to complete the roll paper setting operation. A paper feeding apparatus having such a roll paper setting mechanism is disclosed, for instance, in Japanese Patent Application Unexamined Publication No. Hei. 1-187133.

However, in the conventional image forming apparatuses, since, as described above, the entire roll paper setting operation is manually performed by an operator, the operation is cumbersome.

Further, it may be the case that to facilitate the operation of inserting the paper tip portion between the drive roller and the idler roller of the paper feed roller, excessive paper is drawn out and the tip portion is formed into a loop before the setting. In such a case, due to difficulty in inserting the paper straight, the paper is likely to be set with a lateral deviation from the center line of paper feeding, which may cause oblique paper feeding or defects in a recorded image.

SUMMARY OF THE INVENTION

The present invention has been made in view of the above problems and has an object of providing a roll paper feeding apparatus which facilitates an operation of setting roll paper.

According to the invention, a roll paper feeding apparatus comprises:

- roll paper holding means for holding roll paper, paper being supplied from the roll paper by rotation of the roll paper holding means;
- rotary support means for supporting the roll paper holding means so as to rotate following the rotation of the roll paper holding means;
- rotary paper holding means disposed in the vicinity of a paper set position, for holding the paper supplied from the roll paper; and
- rotational force transmission means for transmitting rotational force of the rotary support means to the rotary paper holding means.

When an operator manually rotates the roll paper holding means, the rotary support means rotates accordingly. The rotational force of the rotary support means is transmitted to the rotary paper holding means by the rotational force transmission means. Therefore, the rotary paper holding means rotates without being directly operated by the operator. After the paper is held (nipped) by the rotary paper holding means, it is fed to the set position semi-automatically by conveying force of the rotary paper holding means. This will facilitate the roll paper setting operation.

There may be added a means for automatically detecting that the paper has reached the set position. Further, there may be provided a means for indicating to an operator the completion of the roll paper setting operation.

A means (torque limiter) for limiting tension of the paper below a predetermined level may be provided in the rotational force transmission mechanism. In this case, it can be avoided that an undesirably large load (tension) is exerted on the paper even when only a small amount of roll paper remains, so that the roll paper setting operation can be performed smoothly.

The employment of a means for preventing loosening of the rolled state of the roll paper also contributes to realization of the smooth roll paper setting operation.

There may be added a means for disabling the transmission of the rotational force after the detecting means detects that the paper has reached the set position. After the completion of the roll paper setting operation, the paper is fed by the rotary paper holding means that is driven by a drive motor.

DESCRIPTION OF THE PREFERRED EMBODIMENT

An embodiment of the present invention is described with reference to the accompanying drawings.

Figure 3:
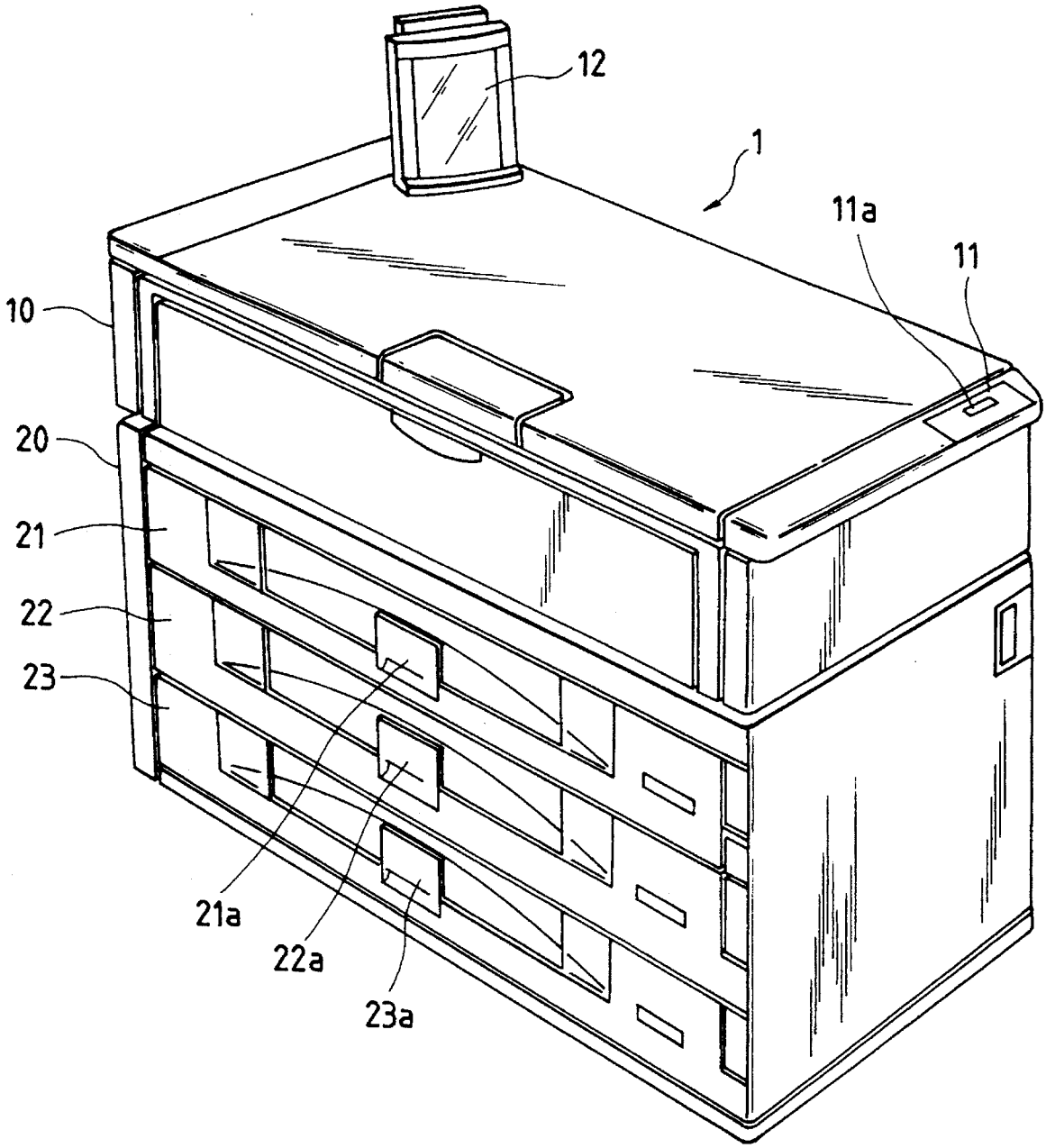
FIG. 3 is a perspective view showing an appearance of a printer using the roll paper feeding apparatus of FIG. 1.

FIG. 3 shows an appearance of a printer 1 having a roll paper feeding apparatus according to an embodiment of the invention.

In the printer 1, a printer main body 10 is placed on a roll paper feeding apparatus 20. An operation panel 11 and a display (CRT display) 12 are provided on the top surface of the printer main body 10. The operation panel 11 includes an indication lamp 11*a* for informing an operator whether a roll paper setting operation has been completed. The display 12 shows the size of the roll paper being used and states of the roll paper during operation of the printer 1 (the remaining amount of the roll paper, occurrence of jamming, etc.). The roll paper feeding apparatus 20 is provided with triple-stacked paper feeding cassettes 21–23, which can be drawn out using pulls 21*a*–23*a*.

Figure 4:
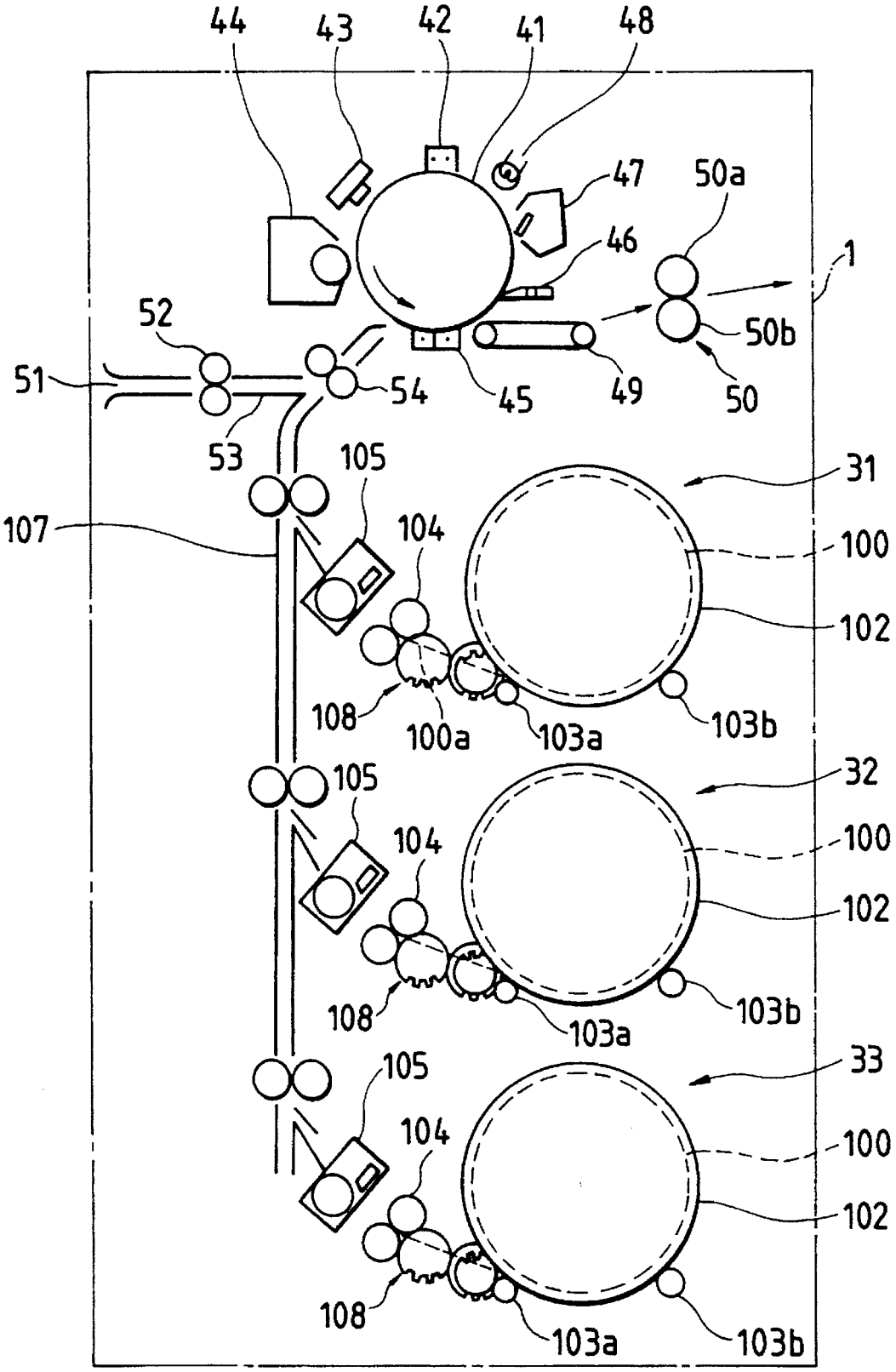
FIG. 4 shows a general internal structure of the printer of FIG. 3.

FIG. 4 shows a general internal structure of the printer 1. A photoreceptor drum 41 as an image carrying body is disposed in the printer 1 rotatably in the direction indicated by an arrow in FIG. 4. The following devices are arranged around the photoreceptor drum 41 in the order as written: a charging corotron 42 for uniformly charging the surface of the photoreceptor drum 41, a writing device 43 for writing image information of a document electrostatically, a developing device 44 for visualizing with toner the image information thus written, a transfer corotron 45 for transferring the toner image onto a sheet 100*a* sent from the roll paper feeding apparatus 20 or a manual feed sheet, a peeling member 46 for peeling the sheet 100*a* that has been subjected to the transfer, a cleaning device 47 for removing the residual toner from the surface of the photoreceptor drum 41, and a discharging lamp 48 for neutralizing charges remaining on the surface of the photoreceptor drum 41. The copy sheet 100*a* that has been subjected to the transfer is carried by a conveyer belt 49 to a fusing device 50 that consists of a heating roller 50*a* and a pressure roller 50*b*, and the toner image is thermally fused to the sheet 100*a*. Then, the sheet 100*a* is output from the printer 1.

A manual feed sheet inlet 51 is provided on the side of the pulls 21*a*–23*a* (left side in FIG. 4) of the printer main body 10. A manual feed sheet inserted through the inlet 51 is driven by a conveying roller 52 so as to be conveyed along a conveying path 53, and then driven by a conveying roller 54 so as to go up along a conveying path 107. A toner image is transferred onto the sheet when it passes between the photoreceptor drum 41 and the transfer corotron 45. The sheet that has been subjected to the transfer is carried by the conveyer belt 49 to the fusing device 50, and passes between the heating roller 50*a* and the pressure roller 50*b*. After the toner image is thermally fused to the sheet, the sheet is output from the printer 1 via a sheet outlet (not shown).

In the roll paper feeding apparatus 20, roll paper feeding mechanisms 31–33 are provided in the respective paper feeding cassettes 21–23 (see FIG. 3). Since the roll paper feeding mechanisms 31–33 have the same structure, only the roll paper feeding mechanism 31 is representatively shogun in FIG. 1 in a detailed manner.

In the roll paper feeding mechanism 31, a core portion 101 of roll paper 100 is held by circular flanges 102 at its respective ends. The flanges 102 rotate in the direction indicated by arrow A in FIG. 1 (clockwise) with the feeding of paper 100*a* from the roll paper 100. A pressing roller 117 is disposed under the roll paper 100. The pressing roller 117 is elastically urged by a spring member 117*a* so as to be pressed against the surface of the roll paper 100, to prevent loosening of the rolled state of the roll paper 100. The flanges 102 are placed on parallel-arranged flange placement rollers 103*a* and 103*b* (rotary support means).

The flange placement rollers 103*a* and 103*b* are rotatable in accordance with the rotation of the respective flanges 102. The paper 100*a* supplied from the roll paper 100 is sent toward a paper feed roller 104 (rotary paper holding means) while being guided by a guide (not shown). The paper feed roller 104 consists of a drive roller 104*a* and an idler roller 104*b* and holds the paper 100*a* therebetween. When rotated in a direction indicated by arrow B in FIG. 1, the paper feed roller 104 feeds the paper 100*a* toward the conveying path 107.

In the roll paper feeding mechanism 31 of this embodiment, the rotational force of the flange placement roller 103*a* is transmitted to the drive roller 104*a* of the paper feed roller 104 via a rotational force transmission mechanism 108, which includes a gear 109 that is concentric with the flange placement roller 103*a*, a gear 110 being engaged with the gear 103*a*, a gear 111 that is concentric with the gear 110, a rocking gear 113 being engaged with the gear 111, and a gear 114 that is engaged with the rocking gear 113 and concentric with the drive roller 104*a*.

With the rotational force transmission mechanism 108, when an operator puts the flanges 102 on the flange placement rollers 103*a* and 103*b* and manually rotates the flanges 102 in the direction indicated by arrow A, the flange placement rollers 103*a* and 103*b* rotate in a direction indicated by arrow a and the rotational force of the roller 103*a* is transmitted to the gear 111 via the gears 109 and 110, and then transmitted to the drive roller 104*a* via the gears 113 and 114. That is, with the rotation of the flanges 102, the paper 100*a* is supplied from the roll paper 100 and the drive roller 104*a* is rotated. After the tip portion of the paper 100*a* is nipped by the drive roller 104*a* and the idler roller 104*b*, the paper 100*a* is fed to a set position semi-automatically by the rotation of the drive roller 104*a* in the direction indicated by arrow B in FIG. 1.

Figure 5:
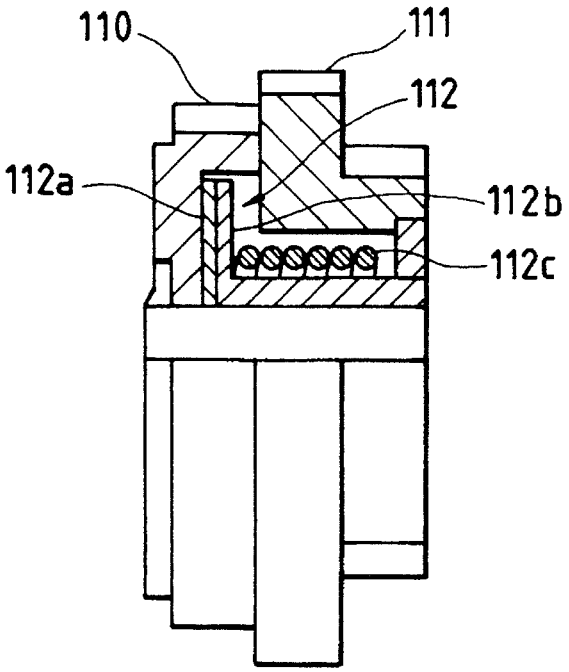
FIG. 5 is a sectional view showing a structure of a torque limiter used in the roll paper feeding apparatus of FIG. 1.

A torque limiter 112 (tension limiting means) is provided between the gears 110 and 111. FIG. 5 shows an internal structure of the torque limiter 112. A slide plate 112*a* is fixed to the input-side gear 110. Another slide plate 112*b* fixed to the output-side gear 111 is pressed against the slide plate 112*a* by elastic force of a spring 112*c*. With this constitution, the gears 110 and 111 rotate together by friction between the slide plates 112*a* and 112*b* when the load of the gears 110 and 111 is smaller than a predetermined value. On the other hand, when the load exceeds that value, a slip occurs between the slide plates 112*a* and 112*b*, so that an undesirably large load is not transmitted between the gears 109 and 113; that is, a locking state does not occur in the gears 109–114.

Figure 1:
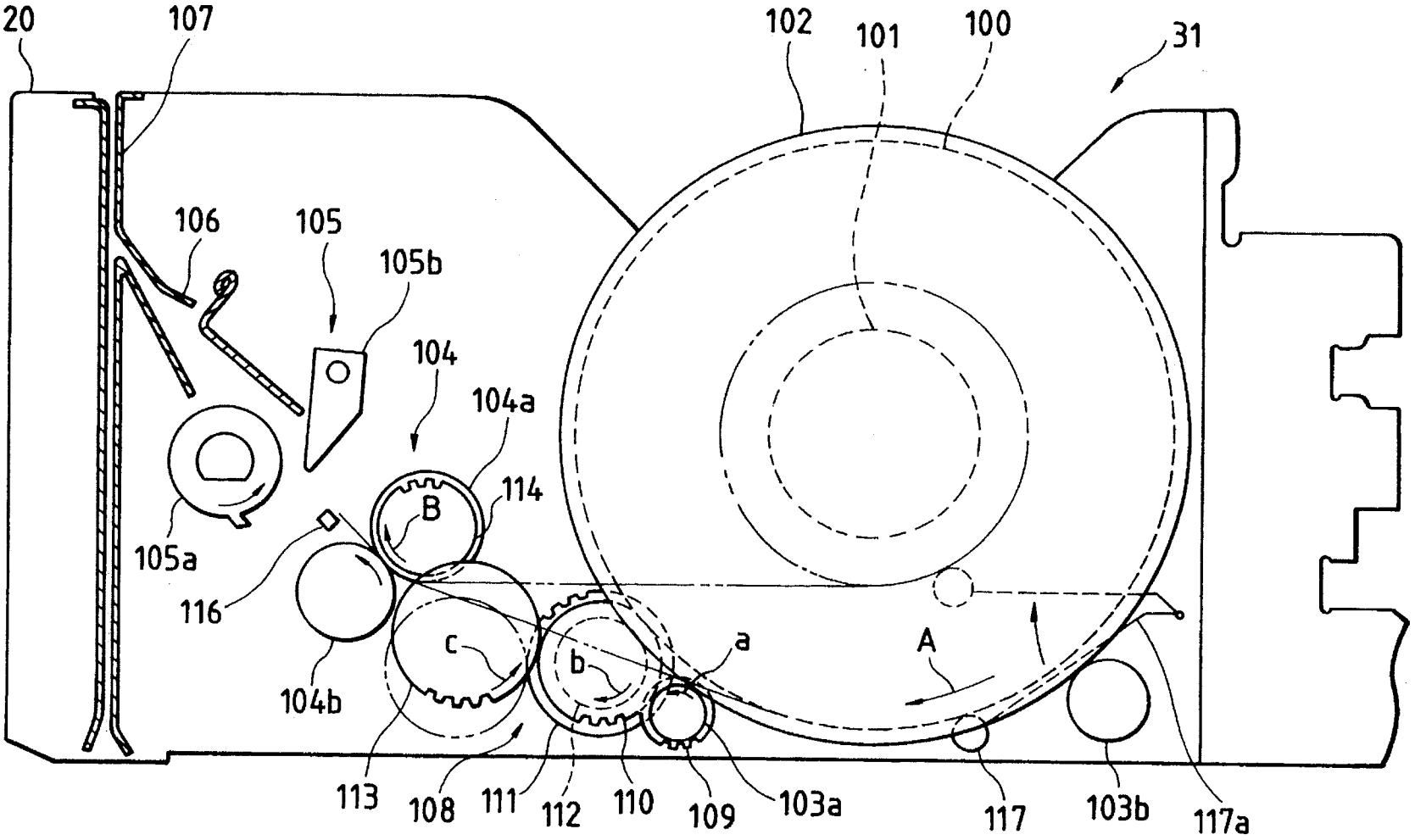
FIG. 1 is a cross-sectional view of a roll paper feeding apparatus according to an embodiment of the invention.

A smaller amount of paper 100*a* is fed by one rotation of the flanges 102 and the paper 100*a* is fed at a lower speed when the remaining roll amount of the roll paper 100 is smaller (indicated by a two-dot chain line in FIG. 1) than when it is smaller (indicated by a dashed chain line in FIG. 1). Therefore, if the gear ratios of the gears 109–114 are set for the case of a large roll amount, the paper feeding speed of the paper feed roller 104 (that takes a constant value in accordance with the rotation speed of the flanges 102) is much different from the supply speed of the paper 100*a* when only a small amount of paper 100*a* remains in the roll paper 100. As a result, an undesirably large load (tension) would be exerted on the paper 100*a*. The torque limiter 112 is employed to prevent such a large load. The gear ratios of the gears 109–114 need to be set so as to avoid slackening of the paper 100*a*.

During the operation of setting the roll paper 100, the rocking gear 113 is located at a position (first position) drawn by a solid line in FIG. 1 to transmit the rotational force of the flange placement roller 103*a* to the gear 114. On the other hand, in the state that the paper feeding cassettes 21–23 are returned to the main body of the roll paper feeding apparatus 20 and set therein after the roll paper setting operation is completed, the rocking gear 113 is shifted to a position (second position) drawn by a two-dot chain line in FIG. 1. In this state, the rotational force is not transmitted from the flange placement roller 103*a* to the gear 114 and the paper feed roller 104. Thereafter, the drive roller 104*a* of the paper feed roller 104 is rotationally driven by a drive motor (not shown) to feed the paper 100*a*.

FIGS. 6–9 show a rocking mechanism (rotational force transmission disabling means) for shifting the rocking gear 113 from the first position to the second position.

Figure 6:
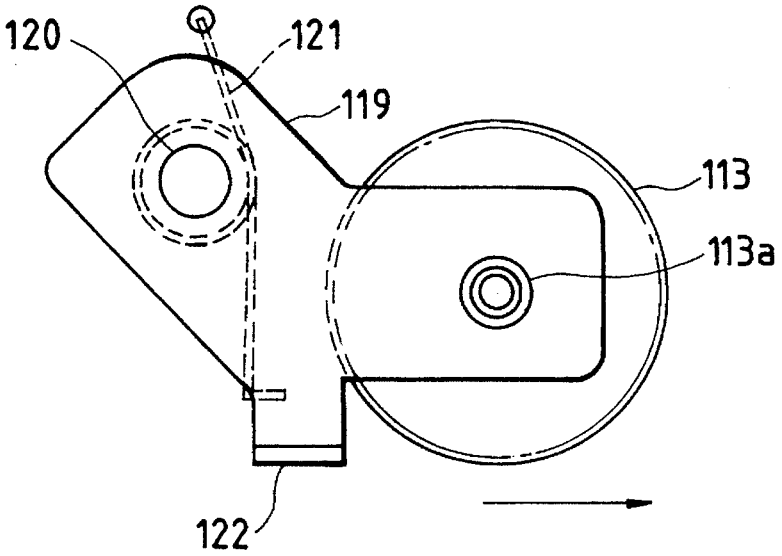
FIG. 6 is a front view showing a structure on the paper feeding cassette side of a rocking mechanism used in the roll paper feeding apparatus of FIG. 1.
Figure 7:
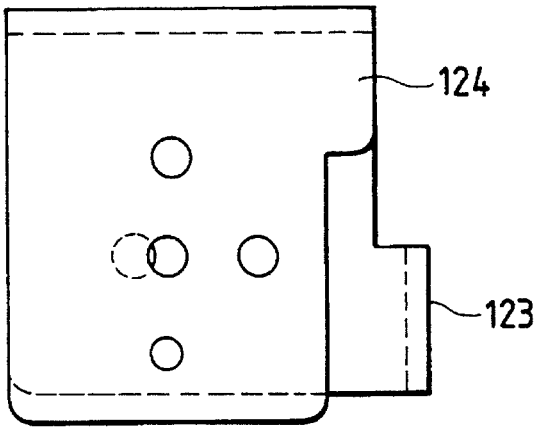
FIG. 7 is a front view showing a structure of a bracket of the rocking mechanism located on the main body side.
Figure 8:
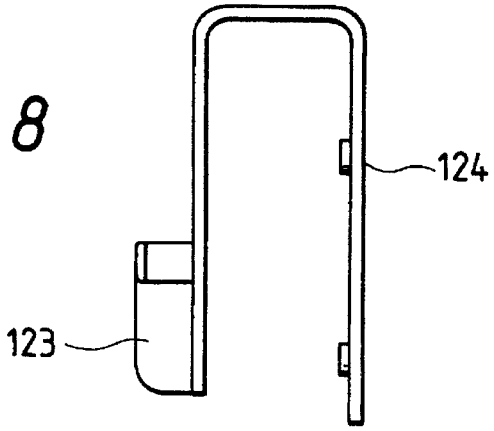
FIG. 8 is a side view of the bracket of FIG. 7.

As shown in FIG. 6, the rocking gear 113 is supported at a tip portion of a rocking arm 119 so as to be rotatable about a shaft 113*a*. The rocking arm 119 is pivotable about a fulcrum shaft 120. A coil spring 121 is fitted to the fulcrum shaft 120. The rocking gear 113 is urged by the elastic force of the coil spring 121 in a direction indicated by an arrow in FIG. 6, i.e., in the insertion direction of the paper feeding cassette 31 (rightward in FIG. 1). In this state, the rocking gear 113 is set at the first position in FIG. 1. The rocking arm 119 has an engaging segment 122 that erects vertically from the paper surface of FIG. 6. On the other hand, a bracket 124 having an engaging portion (stopper) 123 (see FIGS. 7 and 8) is attached to the main body of the roll paper feeding apparatus 20 so that the engaging portion 123 is opposed to the engaging segment 122 of the rocking arm 119.

Figure 9:
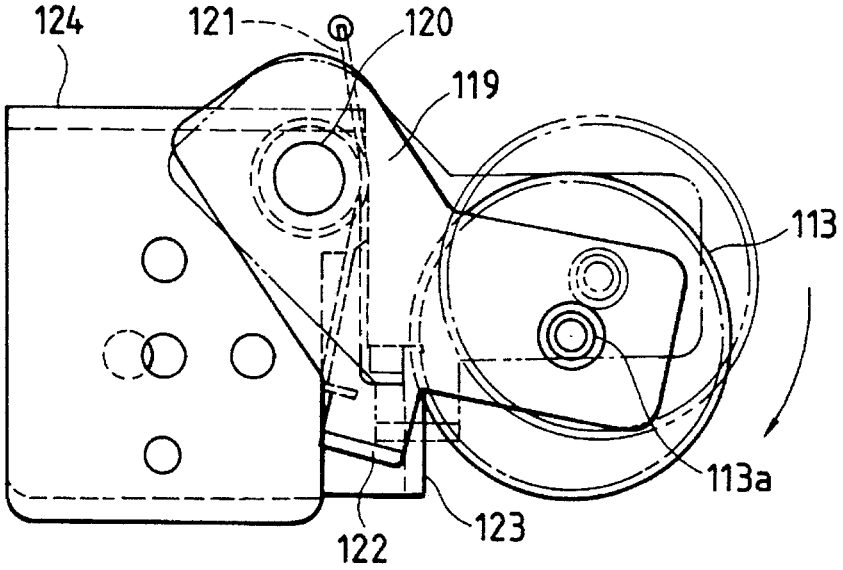
FIG. 9 is a front view showing how the rocking mechanism operates.

In this rocking mechanism, when the roll paper 100 is set and the paper feeding cassette 31 is pushed into the main body of the roll paper feeding apparatus 20 and set therein, the engaging segment 122 of the rocking arm 119 is pressed against the engaging portion 123 of the main body (see FIG. 9), so that the rocking arm 119 rotates clockwise in FIG. 9 about the fulcrum shaft 120 by a certain angle while resisting the elastic force of the coil spring 121. As a result, the rocking gear 113 shifts from the first position to the second position and, as described above, the transmission of the rotational force from the flange placement roller 103*a* to the paper feed roller 104 is disabled.

Returning to FIG. 1, we explain the remaining part of the roll paper feeding mechanism 31. A paper detection sensor 116 (roll paper set state detecting means) is disposed in the vicinity of the downstream portion of the paper conveying path of the paper feed roller 104. At an instant when the paper detection sensor 116 detects the tip of the paper 100*a*, the operation of setting the roll paper 100 is completed.

After the setting of the roll paper 100, image data is sent from a computer or the like (not shown) and the drive motor (not shown) connected to the drive roller 104*a* is energized. The drive roller 104*a* and the idler roller 104*b* rotate in the direction indicated by arrow B to feed the paper 100*a*. The paper 100*a* is cut to a predetermined size by a cutter portion 105 that consists of a rotary blade 105*a* and a fixed blade 105*b*, passed through a paper conveying path 106, and then input to the inside of the printer main body 10 via the paper conveying path 107. Thereafter, as in the case of the manual feed sheet, the cut sheet 100*a* is driven by the conveying roller 54 so as to be delivered to the transfer portion, where a toner image is transferred onto the sheet 100*a* from the photoreceptor drum 41. After the thermal fusing of the toner image, the sheet 100*a* is output from the printer 1.

Next, the operation of the roll paper feeding apparatus of the embodiment is described.

For example, to replace the roll paper 100 of the paper feeding cassette 31 (see FIG. 3) with a new one, an operator pulls out the paper feeding cassette 21 and puts the flanges 102, together with new roll paper 100, on the flange placement rollers 103*a* and 103*b*. When the operator manually rotates the flanges 102 in the direction indicated by arrow A, the flange placement rollers 103*a* and 103*b* and the gear 109 rotate in the direction of arrow a. As a result, the gears 110 and 111 rotate in the direction of arrow b, the gear 113 rotates in the direction of arrow c, and the gear 114 and the drive roller 104*a* rotate in the direction of arrow B.

On the other hand, with the rotation of the flanges 102, the paper 100*a* is supplied from the roll paper 100 and sent to the holding position between the drive roller 104*a* and the idler roller 104*b* via the guide (not shown). Since the drive roller 104*a* rotates following the rotation of the flanges 102, after being held by the drive roller 104*a* and the idler roller 104*b* the paper 100*a* is semi-automatically delivered to the set position while receiving proper tension. When detecting the tip of the paper 100*a*, the paper detection sensor 116 outputs an on-signal, in response to which a control unit (not shown) turns on the indication lamp 11*a* of the operation panel 11 to inform the operator of the completion of the operation of setting the roll paper 100.

Figure 2:
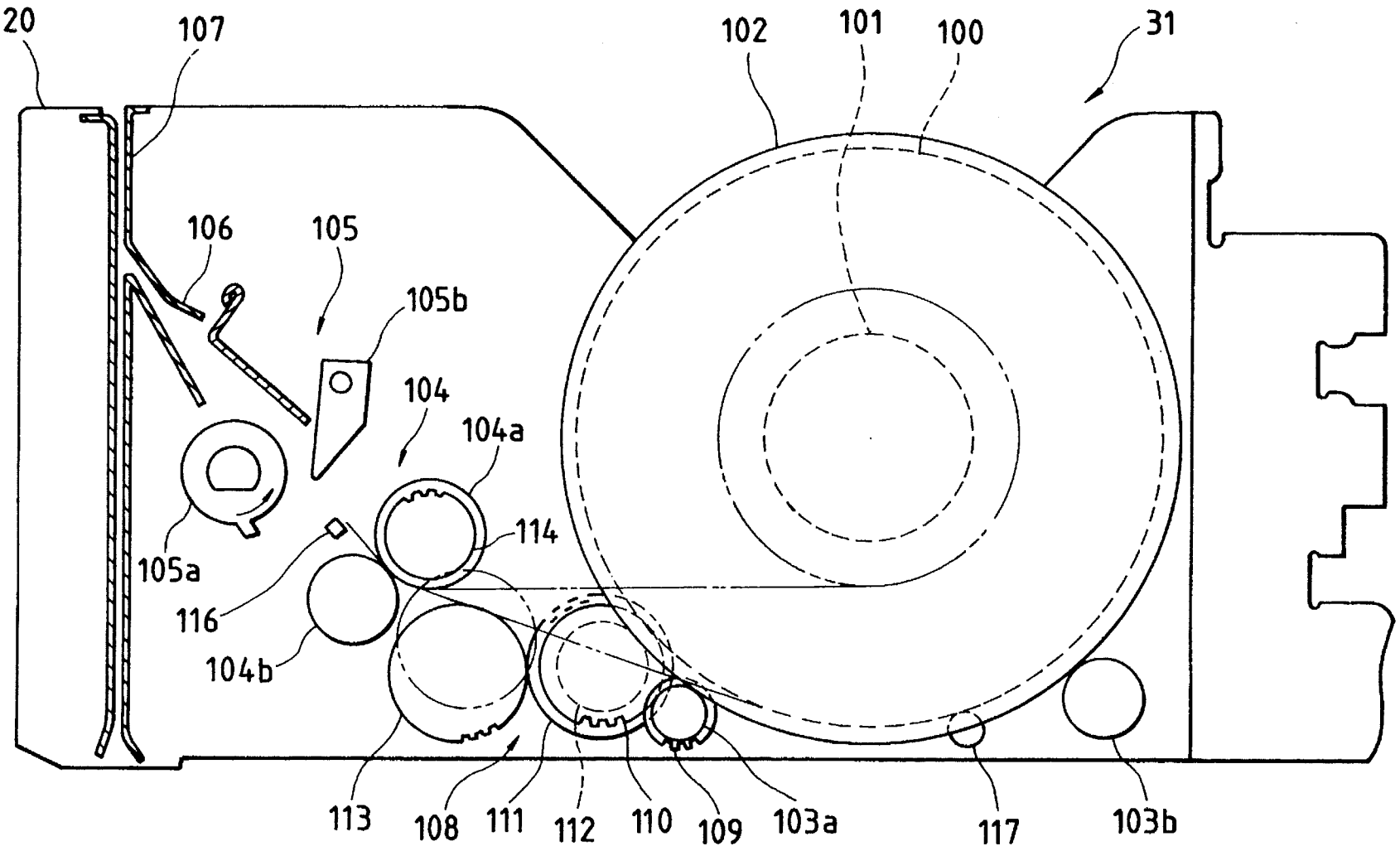
FIG. 2 is a cross-sectional view of the roll paper feeding apparatus of FIG. 1 in a state that roll paper has been set.

When the operator inserts the paper feeding cassette 21 into the main body of the roll paper feeding apparatus 20, the above-described rocking mechanism operates to shift the rocking gear 113 to the second position (see FIG. 2) and the rotational force transmission mechanism 108 finishes its operation. Thereafter, the drive roller 104*a* of the paper feed roller 104 is rotationally driven by the drive motor (not shown). The paper 100*a* is cut by the cutter portion 105 to a predetermined size, and the sheet 100a thus cut is passed through the paper conveying path 106 and input to the inside of the printer main body 10 via the paper conveying path 107. The sheet 100*a* is driven by the conveying roller 54 so as to be delivered to the transfer portion, where a toner image is transferred onto the sheet 100*a* from the photoreceptor drum 41. After the thermal fusing of the toner image, the sheet 100*a* is output from the printer 1.

As described above, according to the roll sheet feeding apparatus of this embodiment, the operation of setting the roll paper 100 can be performed by an operator simply by manually rotating the flanges 102. That is, unlike the conventional case, it is not necessary to manually rotate the paper feed roller. This will facilitate the operation of setting the roll paper 100.

Although the invention is described above by way of the embodiment, the invention is not limited to it but various modifications are possible.

For example, while in the embodiment the torque limiter 112 is of the friction plate type, it may be of other types such as the hysteresis type. While in the embodiment the indication lamp 11*a* is used as the indicating means, the completion of the setting operation may be informed by sound. Further, while in the embodiment the gear mechanism is used as the rotational force transmission means, the rotational force may be transmitted by other means such as a belt.

What is claimed is:

1. A roll paper feeding apparatus comprising:

roll paper holding means for holding roll paper, paper being supplied from the roll paper by rotation of the roll paper holding means;

rotary support means for supporting the roll paper holding means so as to rotate following the rotation of the roll paper holding means;

rotary paper holding means disposed in the vicinity of a paper set position, for holding the paper supplied from the roll paper; and rotational force transmission means for transmitting rotational force of the rotary support means to the rotary paper holding means.

2. The roll paper feeding apparatus of claim 1, further comprising means for detecting that a tip of the paper has reached the set position.

3. The roll paper feeding apparatus of claim 2, further comprising means, coupled to the detecting means, for indicating that the tip of the paper has reached the set position.

4. The roll paper feeding apparatus of claim 2, wherein the rotational force transmission means comprises means for limiting tension of the paper below a predetermined level at least during a period from holding of the tip of the paper by the rotary paper holding means to detection of the tip of the paper by the detecting means.

5. The roll paper feeding apparatus of claim 2, further comprising means for disabling transmission of the rotational force after the detecting means detects that the tip of the paper has reached the set position.

6. The roll paper feeding apparatus of claim 1, further comprising means for preventing loosening of a rolled state of the roll paper.

7. A roll paper feeding apparatus comprising:

a pair of flanges for holding roll paper from its respective sides, paper being supplied from the roll paper by rotation of the flanges;

a pair of flange placement rollers for supporting the respective flanges so as to rotate following the rotation of the flanges;

a pair of paper feed rollers disposed in the vicinity of a paper set position, for holding the paper supplied from the roll paper; and a gear mechanism for transmitting rotational force of one of the flange placement rollers to the paper feed rollers.

8. The roll paper feeding apparatus of claim 7, wherein the gear mechanism comprises a torque limiter.

9. The roll paper feeding apparatus of claim 7, further comprising a rocking mechanism for shifting one gear of the gear mechanism out of its engagement position after a tip of the paper has reached the set position.

* * * * *